US006848506B1

(12) United States Patent
Sharp et al.

(10) Patent No.: US 6,848,506 B1
(45) Date of Patent: Feb. 1, 2005

(54) ROTARY DRIVEN RETRIEVAL TOOL FOR HORIZONTAL DIRECTIONAL DRILLING OPERATIONS

(75) Inventors: Richard Felix Sharp, Perry, OK (US); Matthew L. Dock, Stillwater, OK (US); H. Stanley Mullins, Perry, OK (US); John Allan Skinner, Lucien, OK (US)

(73) Assignee: The Charles Machine Works, Inc., Perry, OK (US)

( * ) Notice: Subject to any disclaimer, the term of this patent is extended or adjusted under 35 U.S.C. 154(b) by 1 day.

(21) Appl. No.: 10/185,295

(22) Filed: Jun. 28, 2002

(51) Int. Cl.[7] ..... E21B 31/12

(52) U.S. Cl. ..... 166/301; 166/98; 294/86.4; 294/86.12

(58) Field of Search ..... 166/301, 98, 377; 294/86.4, 86.17, 86.12, 86.27, 86.22, 86.28, 86.29, 99.1

(56) References Cited

U.S. PATENT DOCUMENTS

| | | | | |
|---|---|---|---|---|
| 672,154 A | | 4/1901 | Taylor | |
| 1,087,262 A | | 2/1914 | Schildwachter | |
| 2,114,988 A | | 4/1938 | Anthony | 294/102 |
| 2,945,720 A | * | 7/1960 | Osmun | 294/86.17 |
| 4,004,835 A | | 1/1977 | Taylor | 294/86.29 |
| 4,023,847 A | | 5/1977 | Webb | 294/86.3 |
| 4,124,245 A | * | 11/1978 | Kuenzel | 294/86.3 |
| 4,548,437 A | | 10/1985 | Driskill | 294/86.3 |
| 4,580,826 A | | 4/1986 | Carver et al. | 294/86.17 |
| 4,648,445 A | | 3/1987 | Caskey | 166/98 |
| 4,945,985 A | | 8/1990 | Lynds | 166/98 |
| 5,054,832 A | | 10/1991 | Davis et al. | 294/86.3 |
| 5,054,833 A | | 10/1991 | Bishop et al. | 294/86.3 |
| 5,094,496 A | | 3/1992 | King, Sr. | 294/96 |
| 5,249,625 A | | 10/1993 | Skipper et al. | 166/98 |
| 5,265,927 A | | 11/1993 | Davidson, Jr. | 294/86.3 |
| 5,639,135 A | | 6/1997 | Beeman | 294/86.25 |
| 5,678,634 A | | 10/1997 | Rehbock et al. | 166/377 |
| 5,865,253 A | | 2/1999 | Gamper et al. | 166/301 |
| 6,679,534 B2 | * | 1/2004 | Schulte | 294/19.1 |
| 6,681,858 B2 | * | 1/2004 | Streater | 166/301 |

FOREIGN PATENT DOCUMENTS

DE 42 25 701 C1 12/1993 ..... E21B/7/20

* cited by examiner

*Primary Examiner*—David Bagnell
*Assistant Examiner*—Daniel Stephenson
(74) *Attorney, Agent, or Firm*—McKinney & Stringer, P.C.

(57) ABSTRACT

A rotating inner member is used to drive operation of a retrieval tool connected to a dual-member drill string. The retrieval tool preferably has a gripping assembly adapted to receive rotational energy from the inner member. In a preferred embodiment, an electric actuator assembly operates the gripping assembly of the retrieval tool. In another preferred embodiment, the gripping assembly of the retrieval tool is mechanically operated by a screw driven cam assembly. In yet another embodiment, the retrieval tool is adapted to grip both the inside and outside of the object to be retrieved.

28 Claims, 6 Drawing Sheets

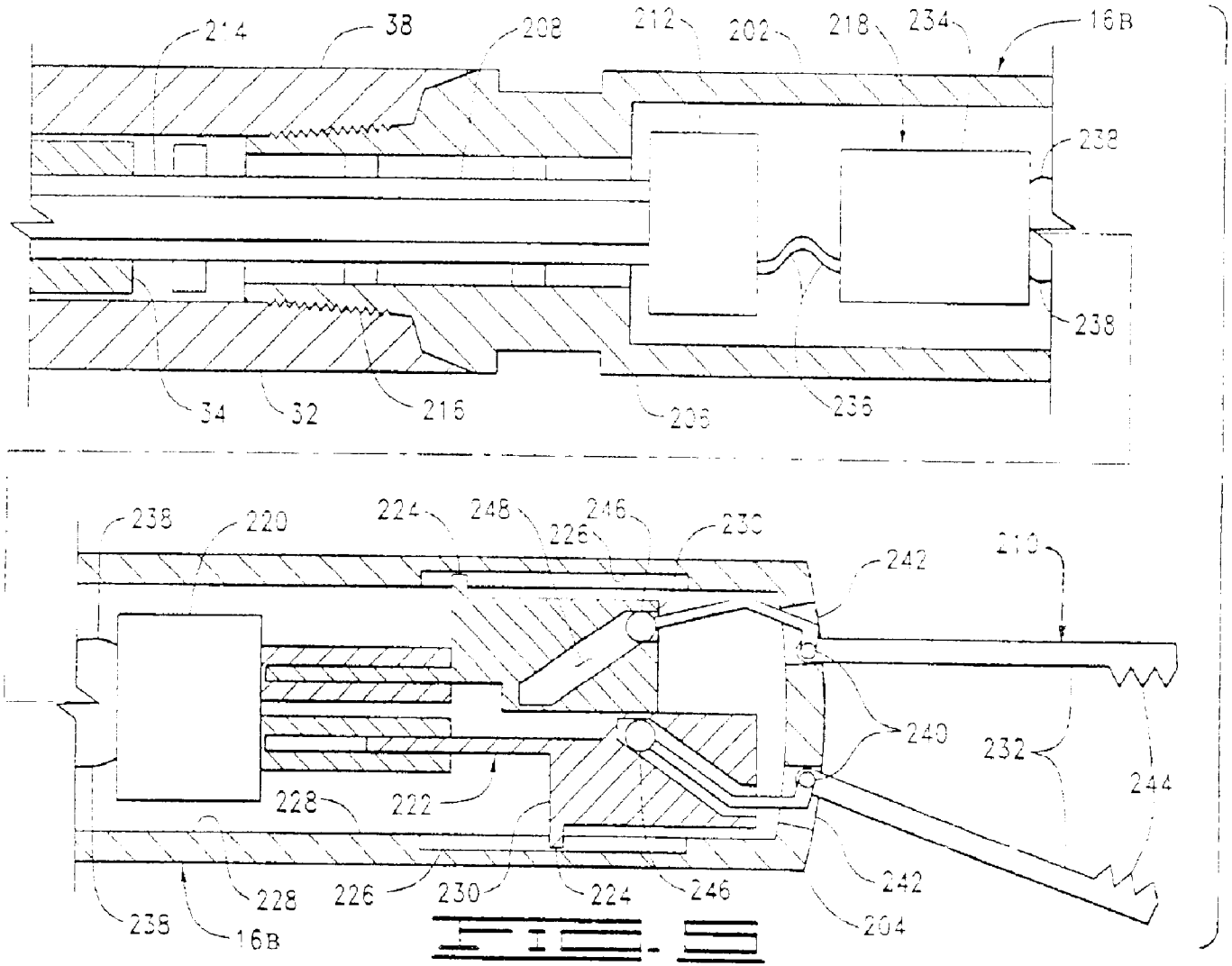
16B
234
218
202
212
208
38
214
238
236
206
216
32
34
244
232
242
240
204
230
246
224
222
226
228
220
16B

ROTARY DRIVEN RETRIEVAL TOOL FOR HORIZONTAL DIRECTIONAL DRILLING OPERATIONS

FIELD OF THE INVENTION

This invention relates generally to retrieval tools, and in particular to downhole retrieval tools for use in horizontal directional drilling operations.

BACKGROUND OF THE INVENTION

During horizontal directional drilling operations, objects can obstruct the progress of the drilling operation. Therefore, a need has arisen for downhole tools capable of retrieving objects from a position a distance inside the borehole. Several devices have been developed for this purpose. However, there is an ongoing need for improved retrieval tools.

SUMMARY OF THE INVENTION

The present invention is directed to a retrieval tool for retrieving an object from its position a distance inside a borehole. The retrieval tool comprises a housing, having a front end and a rear end. An inner member is rotatably supported within the housing. A gripping assembly is mounted at the front end of the housing for movement between a gripping position and a non-gripping position in response to rotation of the inner member.

The present invention further includes a horizontal directional drilling machine. The machine comprises a rotary drive system and a drill string. The drill string has a first end and a second end. The first end of the drill string is operatively connected to the rotary drive system. The drill string comprises a plurality of dual-member pipe sections. Each section comprises a hollow outer member and an inner member positioned longitudinally therein. The inner member and outer member are connectable with the inner members and outer members of adjacent pipe sections. The interconnected inner members are independently rotatable of the interconnected outer members. A retrieval tool is operatively connected to the second end of the drill string so that rotation of the interconnected inner members will drive operation of the tool.

Finally, the present invention includes a method for retrieving objects from a borehole. The object is retrieved using a horizontal directional drilling machine including a rotary drive system and a drill string having a first end and a second end. The rotary drive system is attached to the first end of the drill string. The drill string comprises a plurality of dual-member pipe sections. Each dual-member pipe section comprising a hollow outer member and an inner member therein. The inner and outer members are connectable with the inner and outer members of adjacent pipe sections. The interconnected inner members are rotatable independently of the interconnected outer members. The machine further comprises a retrieval tool attached to the second end of the drill string. The method comprises operating the retrieval tool by rotating the interconnected inner members.

BRIEF DESCRIPTION OF THE DRAWINGS

FIG. 6 shows another alternative embodiment of the retrieval tool wherein the gripping assembly uses an overshot and an undershot assembly to grip the object to be retrieved.

DETAILED DESCRIPTION OF THE PREFERRED EMBODIMENTS

Figure 1:
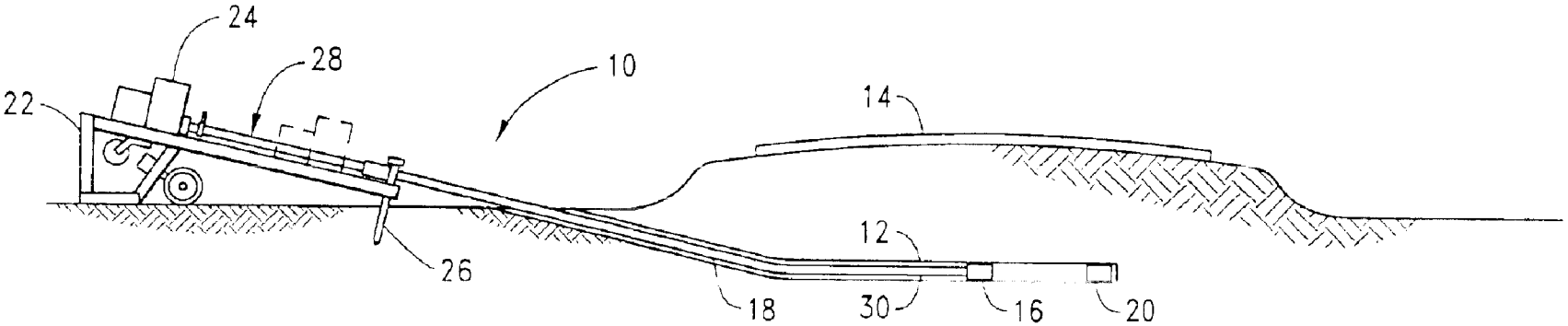
FIG. 1 is a diagrammatic representation of a near surface horizontal directional drilling machine acting on an uphole end of a drill string which, in turn, supports a retrieval tool that is constructed in accordance with the present invention.

Turning now to the drawings in general and FIG. 1 in particular, there is shown therein a horizontal directional drilling machine 10 in accordance with the present invention. FIG. 1 illustrates the usefulness of horizontal directional drilling by demonstrating that a borehole 12 can be made without disturbing an above-ground structure, namely the roadway as denoted by reference numeral 14. FIG. 1 also illustrates the present invention by showing the use of a retrieval tool 16, operatively connected to a drill string 18 to remove an object 20 from its position a distance inside the borehole 12. The object 20 is usually a broken drill string or a downhole tool that has broken away from the drill string. Retrieval tool 16 is used to salvage these expensive parts, and to allow the boring operation to proceed along the desired path.

Referring still to FIG. 1, the horizontal directional drilling machine 10 generally comprises a frame 22 for supporting a rotary drive system 24 and an earth anchor 26. The rotary drive system 24 is movably supported on the frame 22 between a first position and a second position. Movement of the rotary drive system 24, by way of an axial advancement means (not shown), between the first position and the second position axially advances the drill string 18 and retrieval tool 16 through the borehole 12. The earth anchor 26 is driven into the earth to stabilize the frame 22 against the axial force exerted by movement of the rotary drive system 24 during advancement of the retrieval tool 16 and drill string 18.

The drill string 18 is operatively connected to the rotary drive system 24 at a first end 28. In normal drilling operations, the drill string 18 transmits torque from the rotary drive system 24 to a drill bit and carries drilling fluid into the borehole 12. In the present invention, the drill string 18 transmits torque to the retrieval tool 16 for operating and orienting the retrieval tool 16. To operate the retrieval tool 16, the horizontal drilling machine 10 utilizes a drill string 18 comprising a dual-member drill string.

Figure 2:
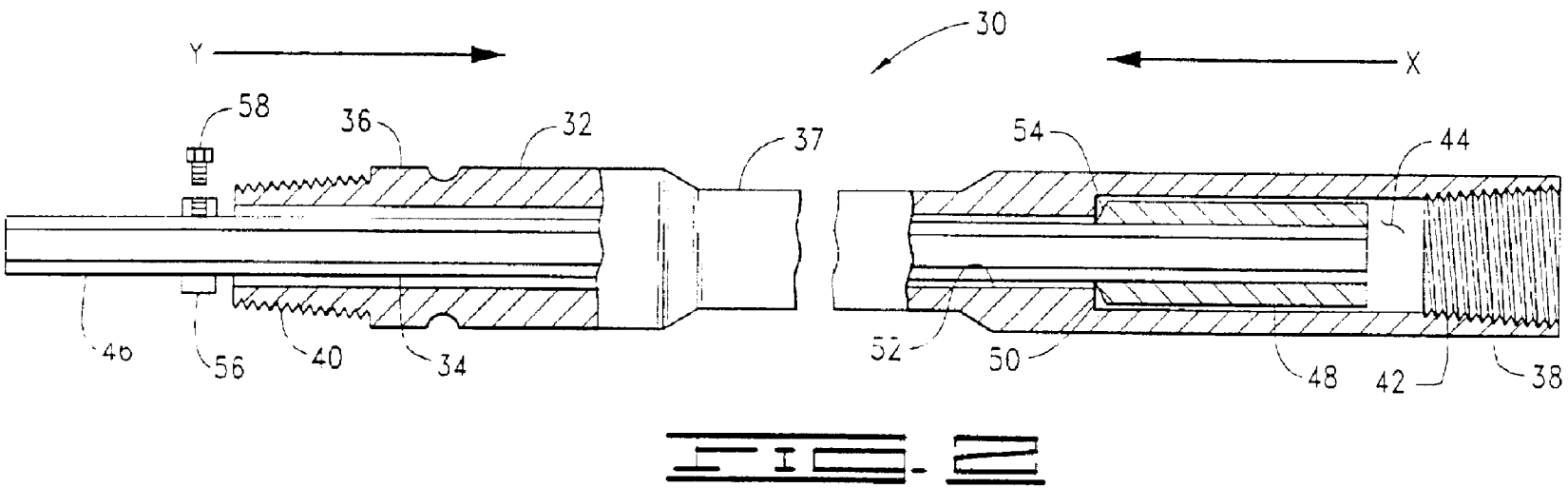
FIG. 2 shows a side elevational, partly sectional view of a representative pipe section used with a dual-member drill string.

Turning now to FIG. 2, there is shown one of a plurality of dual-member pipe sections 30 comprising the dual-member drill string 18 (FIG. 1). The dual-member pipe section 30 comprises a hollow outer member 32 and an inner member 34 positioned longitudinally therein. The inner member 34 and outer member 32 are connectable with the inner members and outer members of adjacent dual-member pipe sections to form the dual-member drill string 18. The interconnected inner members are independently rotatable of the interconnected outer members to drive operation of the retrieval tool 16. It will be appreciated that any dual-member pipe section capable of connecting to adjacent sections of dual-member pipe may be used, but for purposes of illustration, a discussion of a preferred dual-member pipe section 30 follows.

The outer member 32 is preferably tubular having a pin end 36 and a box end 38. The pin end 36 and the box end 38 are correspondingly threaded. The pin end 36 is provided with tapered external threads 40, and the box end 38 is provided with tapered internal threads 42. Thus, the box end 38 of the outer member is connectable to the pin end 36 of a like dual-member pipe section 30. Similarly, the pin end 36 of the outer member 32 is connectable to the box end 38 of a like dual-member pipe section 30.

The external diameter of the pin end 36 and the box end 38 of the outer member 32 may be larger than the external diameter of the central body portion 37 of the outer member 32. The box end of the outer member 32 forms an enlarged internal space 44 for a purpose yet to be described.

The inner member 34 is preferably elongate. Preferably, the inner member 34 is integrally formed and comprises a solid rod. However, it will be appreciated that in some instances a tubular inner member 34 may be satisfactory.

Continuing with FIG. 2, the inner member 34 of the dual-member pipe section is provided with a geometrically-shaped pin end 46 and with a box end 48 forming a geometrically-shaped recess corresponding to the shape of the pin end 46 of the inner member 34. As used herein, "geometrically-shaped" denotes any configuration that permits the pin end 46 to be slidably received in the box end 48 and yet transmit torque between adjacent pipe sections 30. The geometrically-shaped pin end 46 and box end 48 prevent rotation of the pin end 46 relative to the box end 48 when thus connected. A preferred geometric shape for the pin end 46 and box end 48 of the inner member 34 is a hexagon. The box end 48 of the inner member 34 may be brazed, forged or welded or attached to the inner member 34 by any suitable means.

The box end 48 of the inner member 34 is disposed within the box end 38 of the outer member 32. It will now be appreciated why the box end 38 of the outer member 32 forms an enlarged internal space 44 for housing the box end 48 of the inner member. This arrangement facilitates easy connection of the dual-member pipe section 30 with the drill string 18 and the rotary drive system 24.

It is desirable to construct the dual-member pipe section 30 so that the inner member 34 is sidably insertable in and removable from the outer member 32. This allows easy repair and, if necessary, replacement of the inner member 34. In the assembled dual-member pipe section 30, longitudinal movement of the inner member 34 within the outer member 32 must be restricted. Accordingly, stop devices are provided in the dual-member pipe section 30.

An annular shoulder 50 is formed on the inner surface 52 of the outer member 32 to limit longitudinal movement of the inner member 34 within the outer member. In addition, the box end 48 of the inner member 34 forms a shoulder 54 which is larger than the annular shoulder 52. Thus, when the inner member 34 is moved in direction X, shoulder 54 abuts annular shoulder 50 preventing further movement in that direction.

Longitudinal movement of the inner member in the direction of box ends 48 and 38, designated as direction Y in FIG. 2, is restricted by providing a radially projecting annular stop member 56. The pin end 46 of the inner member 34 extends a distance beyond the pin end 36 of the outer member 32. A radially projecting annular stop member 56 is disposed near the pin end 46 of the inner member 34 beyond the pin end 36 of the outer member 32. As shown in exploded view in FIG. 2, the radially projecting annular stop member preferably comprises a collar and a set screw or pin 58. When the inner member 34 is moved in direction Y, the stop collar 56 abuts the pin end 36 of the outer member 32 and obstructs further movement.

Figure 3:
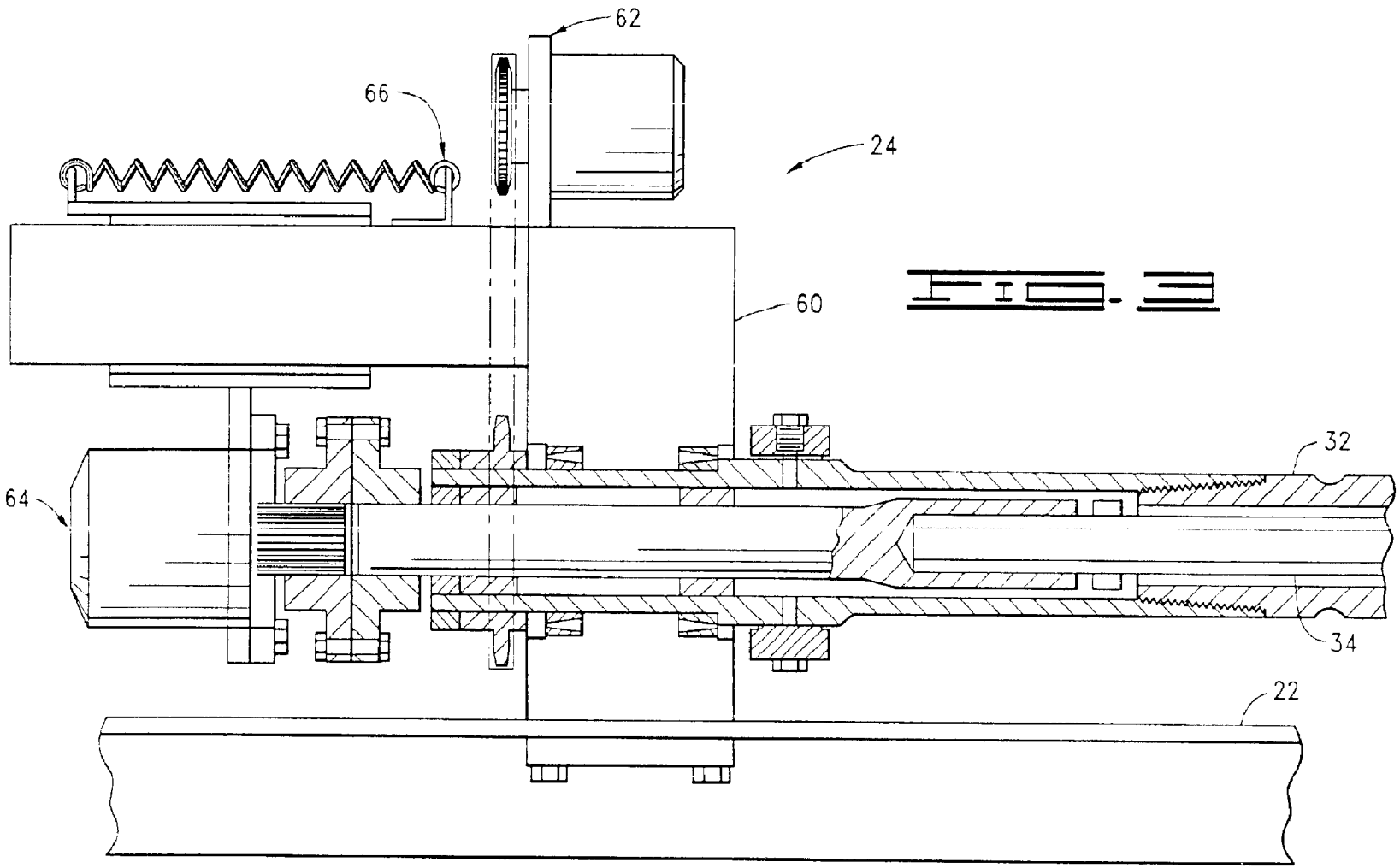
FIG. 3 shows a side elevational, sectional view of the rotary drive system of the present invention.

Turning now to FIG. 3, the rotary drive system 24 for driving operation of the retrieval tool 16 (FIG. 1) is shown in more detail. Because the interconnected outer members and interconnected inner members rotate independently of each other, the rotary drive system 24 has two independent drive groups for independently driving the interconnected outer members and interconnected inner members comprising the drill string 18 (FIG. 1).

The rotary drive system 24 thus preferably comprises a carriage 60 supported on the frame 22. Supported by the carriage 60 is an outer member drive group 62 for driving the interconnected outer members 32, and an inner member drive group 64 for driving the interconnected inner members 34 and the retrieval tool 16. The rotary drive system 24 also comprises a biasing assembly 66 for urging engagement of the inner members. A suitable rotary drive system 24 having an outer member drive group 62 for driving the interconnected outer members 32 and inner member drive group 64 for driving the interconnected inner members 34 is disclosed in more detail in U.S. Pat. No. 5,682,956, the contents of which are incorporated herein by reference.

Figure 4:
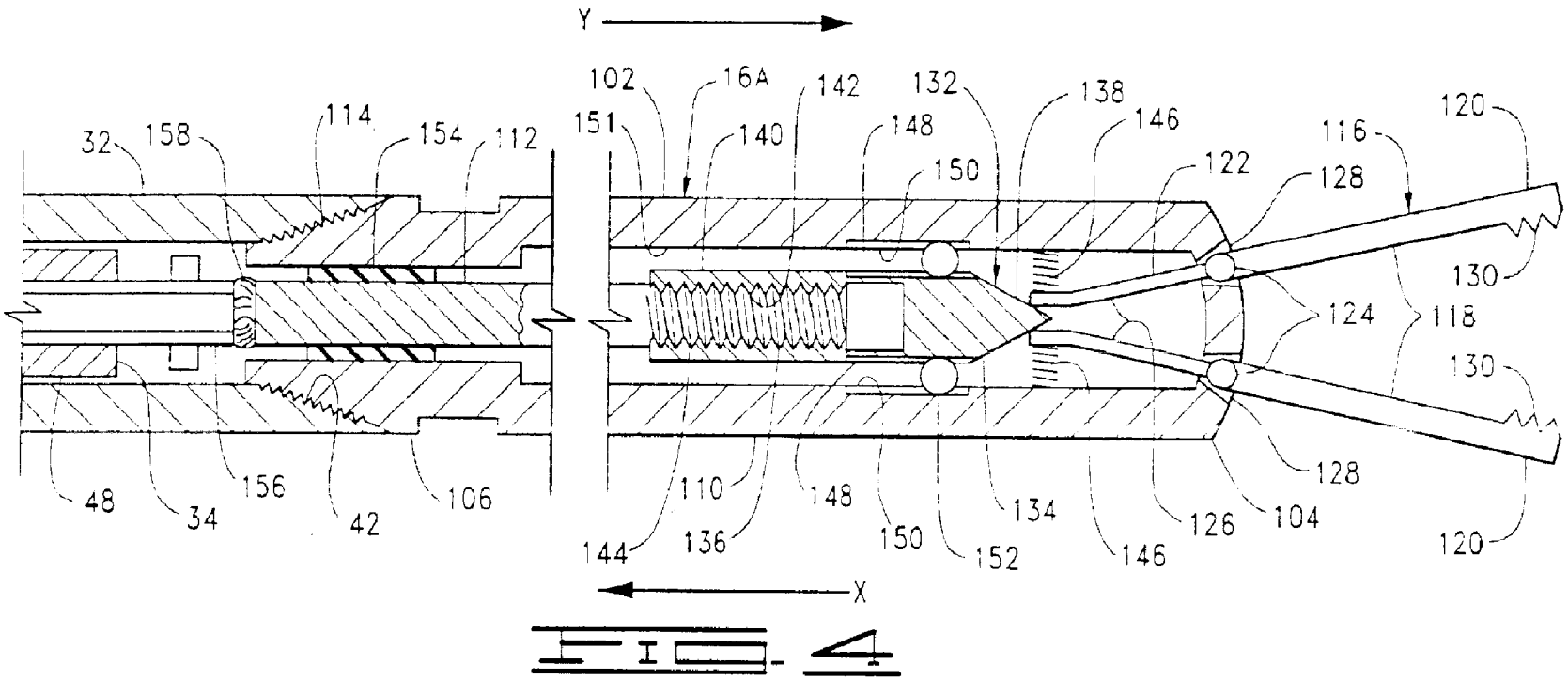
FIG. 4 illustrates a retrieval tool in accordance with the present invention having a mechanically-operated gripping assembly.

Turning now to FIG. 4, there is shown a first embodiment of a retrieval tool 16A constructed in accordance with the present invention. The retrieval tool 16A includes a housing 102 having a front end 104 and a rear end 106. An inner member 112 is rotatably supported within the housing 102 for operation in response to rotation of the interconnected inner members 34. At the front end 104 is mounted a gripping assembly 116 for gripping an object 20 (FIG. 1). The gripping assembly 116 moves between a gripping and non-gripping position in response to the rotary drive system 24 (FIG. 3) rotating the interconnected inner members 34.

The rear end 106 of the housing 102 has tapered external threads 114 for connection with the internal threads 42 of the outer member 32. The threaded connection provides a connection that is capable of transmitting torque from the interconnected outer members 32 of the drill string 18 to the retrieval tool 16A for rotationally orienting the retrieval tool within the borehole 12 (FIG. 1).

The gripping assembly 1116 is comprised of at least a pair of opposing arms 118 movable between a gripping position and a non-gripping position for gripping the object 20. In this embodiment two arms 118 are pivotally connected to the front end 104 of the housing 102 using self-locking pins 124. Pins 124 permit replacement of the arms 118, when worn, or the installation of arms having different configurations, when necessary. Use of pins 124 to mount the arms 118 on the housing 102 permits pivotal movement of the arms 118 between the gripping and non-gripping position. It will be appreciated that attaching the arms is not limited to the use of pins 124, but any means of attaching the opposing arms 118 which allows movement of the gripping assembly 116 between a gripping position and a non-gripping position may be used. It will also be appreciated that the gripping assembly 116 may have more than two arms. For example, the gripping assembly may have three arms equally spaced about the circumference of the housing 102 and adapted to pivot so that all three meet at a common focal point.

Each of the arms 118 has a first end 120 and a second end 122. The first ends 120 of both arms 118 extend through openings 128 formed at the front end 104 of the housing 102 to a position outside the housing. The first ends 120 of both arms 118 terminate with gripping surfaces 130. The gripping surfaces 130 are adapted to provide friction sufficient to grip an object when the arms 118 are moved to the gripping position. The second ends 122 of both arms comprise angled surfaces 126 for sliding engagement with a cam assembly 132. The cam assembly 132 drives movement of the gripping assembly 116 between a gripping position and a non-gripping position in a manner yet to be described.

Continuing with FIG. 4, the cam assembly 132 is operatively connected to the inner member 112 and the gripping assembly 116, including the angled surfaces 126, to drive movement of the gripping assembly 116 in response to rotation of the inner member 112. The cam assembly 132 is supported within the housing 102 and preferably comprises a cam 134 and a screw drive 136 disposed between the inner member 112 and the cam. The cam 134 and screw drive 136 are adapted to drive movement of the gripping assembly 116 between the gripping position and the non-gripping position in response to rotation of the inner member 112. The screw drive 136 converts rotation of the inner member 112 into the axial force necessary to drive the cam assembly 132 in direction Y.

The cam 134 is generally elongate and comprises a tapered end 138 for engaging the angled surfaces 126 of the opposing arms 118, and a base 140 for forming one component of the screw drive 136. The base 140 has an internally threaded bore 142 for engagement with a corresponding externally threaded segment 144 of the inner member 112. The threaded engagement of the cam base 140 and the threaded segment 144 of the inner member forms the screw drive 136.

Now it will be appreciated that when the inner member 112 is rotated in a first direction, the threaded segment 144 of the inner member 112, forming part of the screw drive 136, communicates with the corresponding internal threaded bore 142 of the cam base 140. This rotational interaction causes the cam 134 to move in direction Y. Moving the cam assembly 132 in direction Y forces the tapered end 138 of the cam 134 between the angled surfaces 126 of the arms 118, thus moving the arms to the gripping position.

Rotating the inner member 112 in the opposite, or second direction, reverses the effect of the screw drive 136 thereby moving the cam 134 in direction X. Moving the cam 134 in direction X moves the tapered end 138 in direction X thus removing the cam 134 from its forced position between the opposing arms 118, allowing the gripping assembly 116 to move to the non-gripping position. As the cam 134 is moved in directions, springs 146 push the gripping assembly 116 to the non-gripping position by exerting force upon the second end 122 of arms 118 and thus pivoting the second end of the arms toward the central axis of the housing 102.

Now it will be apparent that for the screw drive 136 to function properly, it is necessary to prevent rotation of the cam 134, relative to the housing 102 when the inner member 112 is rotated. Therefore, the cam 134 has a plurality of elongated recesses 148, disposed about the outer circumference of the cam, and correspondingly aligned recesses 150 formed on the inner surface 151 of the housing. A ball bearing 152 is positioned between each recess 148 and its opposing recess 150 to prevent rotation of the cam assembly 132 about its longitudinal axis. The elongated recesses 148 and 150 in conjunction with ball bearing 152 also function to limit movement of the cam 134 in either direction X or Y to the travel distance of the ball bearing 152.

By preventing rotation of the cam assembly 132, rotational torque is converted into axial force by the screw drive 136 and then transmitted to the cam 134 for moving the gripping assembly 116. Axial force moves the cam 134 axially along the housing's longitudinal axis, within the limits of elongate recesses 148 and 150. Again, axial movement of the cam 134 moves the gripping assembly 116 to either the gripping or non-gripping position.

The inner member 112 is rotatably mounted within the housing 102. A bearing 154 encourages rotation of the inner member 112 parallel to, but spaced from, the inner surface 151 of the housing 102. A geometrically-shaped coupling member 156 is connected to the inner member 112. The coupling member 156 forms a pin end similar to the pin end 46 discussed with reference to dual-member pipe section 30 (FIG. 2). The use of coupling member 156 provides for easy connection with the box end 48 (FIG. 2) of the interconnected inner members 34. The coupling member 156 may be brazed, forged, welded or attached to the inner member 112 by any suitable means at connection 158. As previously discussed, using a geometrically-shaped coupling member 156 allows for efficient connection of the inner member 112 to the drill string 18. Now it will be apparent that the use of a geometrically-shaped coupling member 156, as described herein, to connect the interconnected inner members 34 of the drill string 18 to the retrieval tool 16A is acceptable, but may be accomplished in several different ways.

Figure 5:
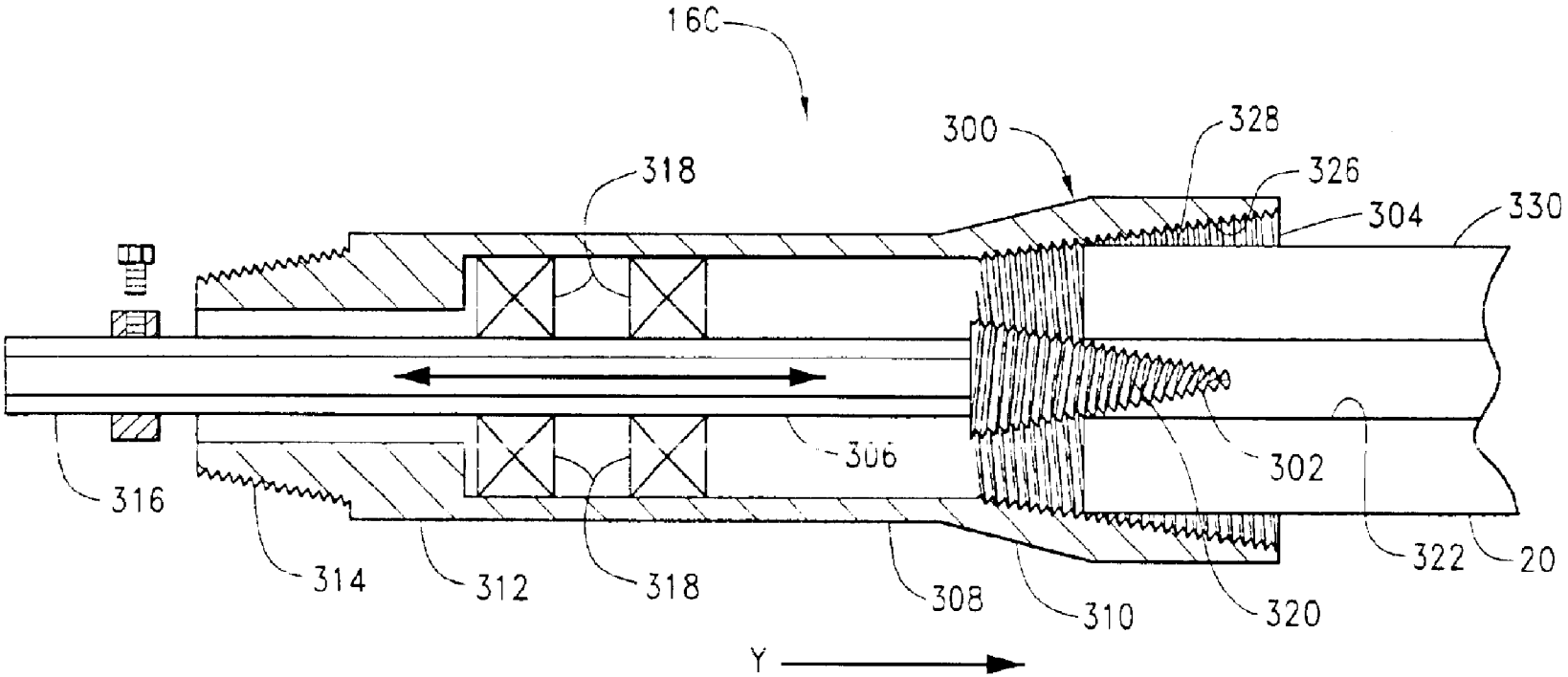
FIG. 5 illustrates an alternative embodiment of the retrieval tool wherein the gripping assembly is operated electrically.

Turning now to FIG. 5, a second embodiment of the retrieval tool will be described. Illustrated in FIG. 5 is a retrieval tool 16B comprising a housing 202 having a front end 204 and a rear end 206. An inner member 208 is rotatably supported within the housing 202 for rotation with the interconnected inner members 34 (FIG. 2) of the drill string 18. Rotating the inner member 208 drives a gripping assembly 210 mounted at the front end 204 of the housing 202 for gripping the object 20 to be retrieved.

Rotation of the inner member 208 is accomplished by coupling the inner member 208 to the rotatable interconnected inner members 34 of the drill string 18. To this end, the generally elongate inner member 208 of the retrieval tool 16B extends beyond the rear end 206 of the housing 202. The inner member 208 is preferably integrally formed and comprises a solid rod. However, it will be appreciated that in some instances a tubular inner member 208 may be satisfactory.

At one end, the inner member 208 engages a power generator 212 for generating power necessary in the retrieval operation. The opposite end of the inner member 208 comprises a geometrically-shaped pin end 214. This geometrically-shaped pin end 214 allows for simple connector-free connection with the correspondingly shaped box end 48 of an adjacent dual-member pipe section 30. The preferred geometrically-shape for pin end 214 of the inner member 208 is a hexagon. However, any geometric configuration which facilitates the transmission of torque from the inner member of a dual-member pipe section to the inner member 208 of the retrieval tool 16B will suffice.

Before moving the gripping assembly 210 to the gripping position, it may become necessary to rotationally orient the retrieval tool 16B. Thus, there must be a torque-transmitting connection between the interconnected outer members 32 of the drill string 18 and the housing 202. Preferably, this connection is made by providing the rear end 206 of the housing 202 with tapered external threads 216. Thus, the housing 202 of the retrieval tool 16A is connectable to the box end 38 of the outer member 32 of a dual-member pipe section 30 (FIG. 2) by threading the housing 202 onto said pipe section. This threaded connection allows for the transmission of torque from the rotary drive system 24 (FIG. 3), through the drill string 18 (FIG. 1), to properly orient the retrieval tool 16B before operating the gripping assembly 210.

Referring still to FIG. 5, there is illustrated an actuator assembly 218 driven by the inner member 208 and adapted to drive movement of the gripping assembly 210 between the gripping position and the non-gripping position. The actuator assembly 218 comprises a generator 212 operatively connected to the inner member 208 to receive rotational energy from the inner member 208. The actuator assembly 218 further comprises a servo motor assembly 220, powered by the generator 212, to drive a cam assembly 222 movably connected to the servo motor assembly 220.

The cam assembly 222 is supported within the housing 202 by tabs 224 extending into elongate recesses 226 formed on the inner surface 228 of the housing 202. The cam assembly 222 is movable between a first position and a second position in response to operation of the servo motor assembly 220. Movement of the cam assembly 222, comprising a pair of independently operable cams 230, to the first position moves the gripping assembly 210. The gripping assembly 210 comprises at least two independently operable opposing arms 232 operatively connected to the cam assembly 222. Thus, moving the cam assembly 222 to the second position moves the gripping assembly 210 to the non-gripping position.

Continuing with FIG. 5, the generator 212 provides power to the servo motor assembly 220 by converting mechanical energy from the rotating inner member 208 to electricity. Now, it will be appreciated that several other methods of powering the servo motor assembly 220 are possible. The generator 212 as used herein, and other methods for powering the servo motor assembly 220 are disclosed in co-owned U.S. patent application Ser. No. 10/047,664 entitled "Using a Rotating Inner Member to Drive a Tool in a Hollow Outer Member," the contents of which are incorporated herein by reference.

As illustrated in FIG. 5, the generator 212 is electrically connected to a control unit 234 by way of electric leads 236. As used herein, the term "control unit" simply defines a receiving, processing, and transmitting unit capable of relaying command signals from an operator to the servo motor assembly 220. Additionally, the control unit 234 may be programmed to perform certain functions based upon information received from the gripping assembly sensors. By way of example, the control unit 234 may be programmed to cause the arms 118 to increase the pressure exerted upon the object 20, in response to the object slipping from the gripping assembly.

A command signal is received by the control unit 234, processed and transmitted to the servo motor assembly 220 by way of leads 238. In response to the command signal, the servo motor assembly 220 moves one or both of the cams 230 comprising the cam assembly 222 to the commanded position.

Continuing with FIG. 5, the gripping assembly 210 is mounted at the front 204 of the housing 202 and comprises at least two opposing arms 232 interconnected to the cams 230. The arms are pivotally mounted at the front 204 of the housing 202 using self-locking pins 240. Again, use of pins 240 to connect the independently operable opposing arms 232 to the housing 202 permits pivotal movement of the arms between the gripping and non-gripping position. The use of independently operable cams 230 in conjunction with independently operable opposing arms 232 permits the operator to actuate one of the arms independent of the other. This capability is valuable in that it facilitates precise gripping of the object to be retrieved.

The arms 232 of the retrieval tool 16B are preferably elongate and extend from inside the housing 202 through openings 242 to a functional point beyond the front end 204 of said housing. The opening 242 is constructed to allow for free movement of the opposing arms 232 between the gripping position and the non-gripping position. It will be appreciated that the opening 242 may be provided with a cover (not shown) that allows free movement of the arms 232 while preventing drilling spoils to enter the housing 202.

The portion of the arms 232 extending from the front end 204 of the housing 202 are formed to comprise a gripping surface 244 to facilitate the acquisition and retention of the object 20 to be retrieved. Now it will be appreciated that several gripping surface structures may be employed. To that end, the gripping surface 244 may be constructed to provide friction sufficient to securely grip the object 20.

The interior portion of each opposing arm 232, that is the portion within the interior of the housing 202, comprises a bearing 246 for reception in a bearing cavity 248 formed on the corresponding independently movable cam 230. As either cam 230 is moved to a first position, the bearing 246 travels through the cavity 248 and moves the exterior portion of the corresponding arm 232 to the gripping position. When either cam 230 is moved by the servo motor assembly 220 to the second position, the bearing 246 travels in the opposite direction through the bearing cavity 248 and moves the corresponding arm 232 to the non-gripping position to release the object Turning now to FIG. 6, there is shown therein an alternative retrieval tool 16C. The retrieval tool 16C of FIG. 6 has a mechanically operated gripping assembly 300 operable in response to rotation of an inner member 306. The gripping assembly 300 comprises a first gripping member 302 and a second gripping member 304. An inner member 306 is rotatably supported within a housing 308 and connectable with the interconnected inner members 34 of the drill string 18.

The housing 308 is constructed to have a front end 310 and a rear end 312. The rear end 312 of the housing 308 has external threads 314 for connecting to the outer member 32 (FIG. 2) of a dual-member drill string 18. As previously discussed, the external threads 314 provide a connection that is capable of transmitting torque from the outer member 32 of the drill string to the second gripping member 304.

The inner member 306 is generally elongate and has a geometrically-shaped pin end 316 at one end and the first gripping member 302 at the other end. As discussed with regard to FIGS. 4 and 5, the geometrically-shaped pin end 316 facilitates easy connection of the inner member 306 to the interconnected inner members 34 while enabling the transfer of rotational energy from the interconnected inner members 34 to the inner member 306. Bearings 318 promote stabilized rotation of the inner member 306 parallel with the longitudinal axis of the housing 308

Rotation of the inner member 306 drives operation of the first gripping member 302. The first gripping member 302 may be integral with the inner member 306. However, it will be appreciated that the first gripping member 302 may be connected to the inner member 306 in any manner sufficient to withstand the severe conditions present during operation of the retrieval tool 16C. The first gripping member 302 comprises an undershot tool having an externally tapered surface with a series of self-cutting threads 320. Self-cutting threads 320 in combination with the tapered surface allow the gripping assembly 300 to grip the inner surface 322 of the object 20 to be retrieved.

The second gripping member 304 is preferably integral with the housing 308 and comprises an internally tapered surface 326 having self-cutting threads 328. The internally tapered surface 326 functions to center the object 20 within the gripping assembly 300. The self-cutting threads 328 cut into and grip the outer surface 330 of the object 20 when the interconnected outer members 32 are rotated in a first direction.

Referring now to FIGS. 1 and 6, the retrieval tool 16C is connected to the drill string 18 and advanced through the borehole 12 using the horizontal directional drilling machine 10. The retrieval tool 16C is advanced until the retrieval tool reaches the object 20 to be retrieved. Once the retrieval tool 16C has reached the object 20, the operator makes a determination as to whether the first gripping member 302 or the second gripping member 304 will be used to make a first connection with the object 20. It is preferable to use the second gripping member 304 first when attempting to grip the object 20 because axially advancing and rotating the second gripping member 304 centers the object 20 within the retrieval tool 16C and grips the outer surface 330 to stabilize the object 20.

Once the second gripping member 302 has established a secure grip on the object 20, the first gripping member 302 may be axially advanced in direction Y and rotated to grip the inner surface 322 of the object 20. Rotating and axially advancing the first gripping member 302 using the inner member 306 causes the self-cutting threads 320 to cut into and grip the inner surface 322 of the object 20.

The inner member 306 may be rotated in the opposite direction of the housing 308 and the second gripping member 304 to exert counter-gripping forces on the object 20. Counter-rotating the gripping members in this manner enhances the gripping forces on the object 20 such that the operator may rotate or rock the object 20 to break it loose. Once the object 20 has been broken loose the operator may either withdraw the tool 16C and the object or continue along the desired bore path. It will also be appreciated that self-cutting threads 320 and 328 may be oriented so that they oppose each other, thus allowing rotation of both the first gripping member 302 and the second member 304 in the same direction to grip the object 20.

Any one of retrieval tools 16A, 16B or 16C may have several sensors capable of assisting the operator in retrieving the object. The retrieval tools may have a plurality of gripping assembly sensors (not shown) supported on any one of the gripping assemblies described above. The sensors may be adapted to provide the operator with feedback regarding positioning of gripping assembly, whether the gripping assembly has made contact with the object 20, and the amount of force being exerted upon the object 20 by the gripping assembly. Additionally, retrieval of the object 20 may be further assisted by a beacon (not shown) supported near any one of the previously described gripping assemblies 116, 210 or 300. The beacon may be adapted to provide the operator with information about the retrieval tool's position and orientation.

The present invention also comprises a method for retrieving objects from a borehole 12. In accordance with the method of the present invention, the object 20 is removed from the borehole 12 using a horizontal directional drilling machine 10. The horizontal directional drilling machine is comprised of a drill string 18 having a first end and a second end, and a rotary drive system 24 attached to the first end of the drill string 18. A retrieval tool is attached to the second end of the drill string 18. Preferably one of the retrieval tools, 16A, 16B or 16C as described herein, may be used for this purpose. The drill string 18 comprises a plurality of dual-member pipe sections 30. The dual-member pipe sections 30 each comprise a hollow outer member 32 and an inner member 34 as previously described. The outer members 32 and inner member 34 are connectable to the corresponding outer members 32 and inner members 34 of adjacent dual-member pipe sections 30 to form a drill string comprising interconnected inner members which are rotatable independently of the interconnected outer members.

Having determined the need for retrieving an object from its position a distance inside a borehole, the retrieval tool 16 is attached to the second end of the drill string 18. The retrieval tool 16 is then positioned to retrieve the object by advancing, withdrawing or rotating the interconnected outer members. As the retrieval tool is axially advanced towards the object 20, additional sections of dual-member pipe 30 are added to extend the length of the drill string 18. Using the interconnected outer members to position the retrieval tool 16 allows the operator to reposition the gripping assembly until the optimal gripping position is attained.

Once the retrieval tool 16 is positioned, the interconnected inner members are rotated to operate the gripping assembly of the retrieval tool 16. The gripping assembly is movable between a gripping position and an non-gripping position in response to rotation of the interconnected inner members. After the retrieval tool has gripped the object 20, the drill string 18 and retrieval tool 16 are withdrawn from the borehole 12. After the object 20 is withdrawn from the borehole 12, the gripping assembly is moved to the non-gripping position to release the object 20.

What is claimed is:

1. A downhole retrieval tool for use in a drill string, wherein the drill string comprises a plurality of dual-member pipe sections, each dual-member pipe section comprising a hollow outer member and an inner member positioned longitudinally therein, wherein the outer member is connectable with the outer members of adjacent pipe sections and the inner member is connectable with the inner members of adjacent pipes sections, wherein the interconnected inner members are rotatable independently of the interconnected outer members, the downhole retrieval tool comprising:

a housing connectable with the outer member of the dual-member drill string, wherein in response to movement of the outer member the housing may be moved to a particular position;

a rotatable member supported by the housing and operable by rotation of the interconnected inner members of the drill string; and a gripping assembly operatively connected to the rotatable member for movement between a gripping position and a non-gripping position in response to rotation of the rotatable member.

2. The tool of claim 1 further comprising an actuator assembly driven by rotation of the rotatable member and adapted to power operation of the gripping assembly.

3. The tool of claim 2 wherein the actuator assembly comprises a generator operatively connected to the rotatable member, and a servo motor assembly powered by the generator; wherein a cam assembly is movably connected to the servo motor assembly for movement between a first position and a second position; and wherein the gripping assembly comprises at least two opposing arms operatively connected to the cam assembly for movement between the gripping position when the cam assembly is in the first position and the non-gripping position when the cam assembly is in the second position.

4. The tool of claim 3 wherein the cam assembly comprises:

a pair of independently operable cams;

wherein the cams are interconnected to the opposing arms and the rotatable member to operate the arms independently.

5. The tool of claim 1 wherein the rotatable member is rotatable in a first direction to move the gripping assembly to the gripping position; and wherein the rotatable member is rotatable in a second direction to move the gripping assembly to a non-gripping position.

6. The tool of claim 1 further comprising a cam assembly operatively connected to the rotatable member and the gripping assembly, and adapted to drive movement of the gripping assembly in response to rotation of the rotatable member.

7. The tool of claim 6 wherein the gripping assembly comprises a pair of arms.

8. The tool of claim 6 wherein the cam assembly comprises a cam and a screw drive, operatively connected between the rotatable member and the cam to drive movement of the gripping assembly in response to rotation of the rotatable member.

9. The tool of claim 1 further comprising an elongate housing, wherein the housing is rotatable about its longitudinal axis; wherein the gripping assembly comprises a first gripping member operable in response to rotation of the rotatable member; and a second gripping member operable in response to rotation of the housing; wherein the housing and the rotatable member are rotated independently to move the first and second gripping members between the gripping position and the non-gripping position.

10. The tool of claim 9 wherein the first gripping member comprises a gripping surface adapted to internally grip the object; and wherein the second gripping member comprises a gripping surface adapted to externally grip the object.

11. A horizontal directional drilling machine comprising:

a rotary drive system;

a drill string having a first end and a second end;

wherein the first end of the drill string is operatively connected to the rotary drive system;

wherein the drill string comprises a plurality of dual-member pipe sections, each dual-member pipe section comprising a hollow outer member and an inner member positioned longitudinally therein, wherein the inner member and outer member are connectable with the inner members and outer members of adjacent pipe sections, and wherein the interconnected inner members are independently rotatable of the interconnected outer members; and a retrieval tool operatively connected to the second end of the drill string, the retrieval tool comprising:

a rotatable member operable by rotation of the interconnected inner members; and a gripping assembly operatively connected to the rotatable member for movement between a gripping position and a non-gripping position in response to rotation of the rotatable member.

12. The horizontal directional drilling machine of claim 11 wherein the inner members are solid.

13. The horizontal directional drilling machine of claim 11 wherein the pipe section outer members have pin ends and box ends correspondingly threaded for connection with the pin and box ends of adjacent pipe sections, wherein the retrieval tool comprises a housing with an end correspondingly threaded for connection with the adjacent end of the outer member of the adjacent pipe section of the drill string, and wherein the rotatable member comprises a geometrically shaped end slidably engageable with the correspondingly shaped end of the inner member of the adjacent pipe section of the drill string.

14. The horizontal directional drilling machine of claim 11 wherein the retrieval tool comprises:

a housing having a front end and a rear end;

wherein the rotatable member is rotatably supported within the housing; and wherein the gripping assembly is mounted at the front end of the housing for movement between the gripping position and the non-gripping position in response to rotation of the interconnected inner members of the drill string.

15. The horizontal directional drilling machine of claim 14 wherein the interconnected inner members are rotatable in a first direction to move the gripping assembly to the gripping position and wherein the interconnected inner members are rotatable in a second direction to move the gripping assembly to the non-gripping position.

16. The horizontal directional drilling machine of claim 14 further comprising a cam assembly operatively connected to the rotatable member and the gripping assembly, and adapted to drive movement of the gripping assembly in response to the rotation of the interconnected inner members of the drill string.

17. The horizontal directional drilling machine of claim 16 wherein the gripping assembly comprises a pair of opposing arms.

18. The horizontal directional drilling machine of claim 17 wherein the cam assembly comprises a cam and a screw drive operatively connected between the rotatable member and the cam to drive movement of the gripping assembly in response to rotation of the rotatable member.

19. The horizontal directional drilling machine of claim 14 wherein the housing is rotatable about a longitudinal axis; wherein the gripping assembly comprises a first gripping member operable in response to rotation of the rotatable member and a second gripping member operable in response to rotation of the housing; and wherein the housing and the rotatable member are rotated independently of each other to move the first and second gripping members between the gripping position and the non-gripping position.

20. The horizontal directional drilling machine of claim 19 wherein the first gripping member comprises a gripping surface adapted to internally grip the object; and wherein the second gripping member comprises a gripping surface adapted to externally grip the object.

21. The horizontal directional drilling machine of claim 11 wherein the retrieval tool further comprises an actuator assembly driven by rotation of the rotatable member and adapted to power operation of the gripping assembly.

22. The horizontal directional drilling machine of claim 21 wherein the actuator assembly comprises a generator operatively connected to the rotatable member and a servo motor assembly powered by the generator, wherein a cam assembly is movably connected to the servo motor assembly for movement between a first position and a second position; and wherein the gripping assembly, comprising a pair of operably opposing arms, is operatively connected to the cam assembly for movement between the gripping position when the cam assembly is in the first position and the non-gripping position when the cam assembly is in the second position.

23. The horizontal directional drilling machine of claim 22 wherein the opposing arms operate independently of each other.

24. The horizontal directional drilling machine of claim 23 wherein the cam assembly comprises:

a pair of independently operable cams;

wherein the cams are interconnected to the opposing arms and the rotatable member to operate the opposing arms independently in response to rotation of the rotatable member.

25. A method for retrieving objects from a borehole using a horizontal directional drilling machine including a rotary drive system, a drill string having a first end and a second end, wherein the rotary drive system is attached to the first end of the drill string, wherein the drill string comprises a plurality of dual-member pipe sections, each dual-member pipe section comprising a hollow outer member and an inner member therein, wherein the inner and outer members are connectable with the inner and outer members of adjacent pipe sections, and wherein the interconnected inner members are rotatable independently of the interconnected outer members, wherein the machine further comprises a retrieval tool attached to the second end of the drill string, the method comprising:

operating the retrieval tool by rotating the interconnected inner members.

26. The method of claim 25 wherein the method further comprises first positioning the retrieval tool by advancing, withdrawing, or rotating the interconnected outer members.

27. The method of claim 26 wherein the retrieval tool comprises a gripping assembly movable between a gripping position and a non-gripping position and wherein the operating step comprises moving the gripping assembly between the gripping position and the non-gripping position by rotating the interconnected inner members of the drill string.

28. The method of claim 27 wherein the step of moving the gripping assembly between a gripping position and a non-gripping position comprises rotating the interconnected inner members of the drill string in a first direction to move the gripping assembly to the gripping position and rotating the interconnected inner members of the drill string in a second direction to move the gripping assembly to the non-gripping position.

* * * * *